US007442099B2

(12) United States Patent
Egawa et al.

(10) Patent No.: US 7,442,099 B2
(45) Date of Patent: Oct. 28, 2008

(54) METAL TERMINAL AND ELECTRIC DISTRIBUTION BOX PROVIDED WITH THE SAME

(75) Inventors: Masatoshi Egawa, Kakegawa (JP); Takuya Nakayama, Kakegawa (JP); Hiroyuki Wakamatsu, Kariya (JP); Hirofumi Wada, Kariya (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/603,166

(22) Filed: Nov. 22, 2006

(65) Prior Publication Data

US 2007/0123114 A1 May 31, 2007

(30) Foreign Application Priority Data

Nov. 22, 2005 (JP) ..... P.2005-337548

(51) Int. Cl.
*H01R 11/11* (2006.01)

(52) U.S. Cl. ..... 439/883; 439/76.2

(58) Field of Classification Search ..... 439/801, 439/881, 883, 857, 860, 949, 76.2
See application file for complete search history.

(56) References Cited

U.S. PATENT DOCUMENTS 1,847,689 A * 3/1932 Gribbie ..... 439/883
3,340,497 A * 9/1967 Balint ..... 439/872
4,174,147 A * 11/1979 Waddington et al. ..... 439/636
4,679,888 A * 7/1987 Williams ..... 439/883
4,832,629 A * 5/1989 Sasaki et al. ..... 439/792
5,575,697 A * 11/1996 Kaedei ..... 439/883
5,645,457 A * 7/1997 Hirayama et al. ..... 439/801
5,997,341 A * 12/1999 Ushiyama et al. ..... 439/480
6,053,780 A * 4/2000 Ono et al. ..... 439/810
6,126,493 A * 10/2000 Price et al. ..... 439/801

FOREIGN PATENT DOCUMENTS

JP 11-031450 A 2/1999

* cited by examiner

*Primary Examiner*—Thanh-Tam T Le
(74) *Attorney, Agent, or Firm*—Sughrue Mion, PLLC

(57) ABSTRACT

A metal terminal adapted to be fixedly held between a terminal connecting portion and a fastening member provided at the terminal connecting portion, the metal terminal comprising an electrical contact portion which can be slid to be inserted between the fastening member and the terminal connecting portion so as to be connected to the terminal connecting portion; a wire connecting portion which extends from the electrical contact portion, a wire being adapted to be connected to the wire connecting portion; and an upstanding piece portion which is provided so as to extend in an upstanding manner from the electrical contact portion, and is disposed rearwardly of a connection part of the electrical contact portion in a direction of sliding of the electrical contact portion. The connection portion of the electrical contact portion is adapted to be held between the fastening member and the terminal connecting portion.

10 Claims, 7 Drawing Sheets

METAL TERMINAL AND ELECTRIC DISTRIBUTION BOX PROVIDED WITH THE SAME

BACKGROUND OF THE INVENTION

This invention relates to a metal terminal connected to an end portion of a wire installed in an automobile or the like serving as a mobile body, and also relates to an electric distribution box provided with such metal terminal.

Generally, various electronic equipments, including lamps such as headlamps and tail lamps and motors such as a starter motor and an air conditioner motor, are mounted on an automobile serving as a mobile body.

In order to supply electric power to the above various electronic equipments, junction blocks have been provided at suitable portions of the automobile. The junction block is formed by combining various electric circuit units of many fuses, relays, etc., together.

The junction block often includes fuses, relays, bus bars, etc., and therefore is often called a fuse block or a relay box, or generically called an electric distribution box. In the present specification, the fuse block, the relay box and the junction block will hereinafter be generically called an electric distribution box.

An electric distribution box includes a box body forming a shell, and a metal terminal (see, for example, JP-A-11-31450). A plurality of mounting portions for the mounting of electric parts (such as the above relays, fuses and fusible links) thereon are formed, for example, at an upper surface of the box body. Further, a terminal connecting portion formed of an electrically-conductive metal sheet and a bolt (fastening member) threaded in this terminal connecting portion are provided at the upper surface. The distance of a head of the bolt from the terminal connecting portion can be changed by threading the bolt into the terminal connecting portion. Connectors of a wire harness installed in the automobile is fitted, for example, to a lower surface of the box body.

The wire harness includes a plurality of wires, and connectors secured to end portions, etc., of the wires. The connectors are fitted to the above various electronic equipments mounted on the automobile and the box body.

The box body receives bus bars connecting the various electric parts (mounted at the above mounting portions) to terminals of the connectors of the wire harness in a predetermined pattern.

The metal terminal is formed of a relatively-thick electrically-conductive metal sheet, and includes a flat plate-like electrical contact portion and a wire connecting portion which are formed integrally with each other. A hole or a notch for the passage of a threaded portion of the bolt therethrough is formed in the electrical contact portion. By sliding the electrical contact portion, the threaded portion of the bolt can be inserted into the hole or the notch. Then, when the bolt is threaded into the terminal connecting portion, the electrical contact portion is held between the head of the bolt and the terminal connecting portion, and is secured to the box body.

The wire connecting portion is continuous with the electrical contact portion. The electrical contact portion has press-clamping piece portions for being press-fastened to a wire connected to a power source or the like. The press-clamping piece portions are thus press-fastened to the wire, so that the wire connecting portion is connected to a conductor of the wire. This wire is connected to the power source.

In the above electric distribution box, the electrical contact portion of the metal terminal (to which the wire connected to the power source is fixedly secured) is mounted on the terminal connecting portion (provided at the upper surface of the box body) by the bolt. Desired electric parts are mounted at the mounting portions, and the connectors of the wire harness are fitted to the lower surface of the box body. In this manner, the electric distribution box is assembled. The electric distribution box supplies electric power from the power source to the above electronic equipments via the fusible links, the wires of the wire harness, etc.

In order to achieve a compact (small-size) design of the box body of the above conventional electric distribution box, it can be proposed to provide a construction in which the metal terminal is formed such that the wire connecting portion extends perpendicularly from the electrical contact portion, and also a recessed groove is formed in the box body, and is recessed from an outer wall surface of the box body, and the wire connecting portion and the wire connected to this wire connecting portion are received in this recessed groove. In this case, the direction in which the electrical contact portion is inserted in order to insert the threaded portion of the bolt into the hole or the notch is perpendicular to the direction of juxtaposition of the electric contact portion and the wire connecting portion.

In this case, when sliding the electrical contact portion, the worker presses a portion of the electrical contact portion disposed in the vicinity of the hole or the notch. As a result, fibers of the worker's glove or others deposit on the portion of the electrical contact portion disposed in the vicinity of the hole or the notch, and therefore there is a fear that electrical connection between the electrical contact portion (that is, the metal terminal) and the terminal connecting portion may be incomplete. And besides, the electrical contact portion is formed into the flat plate-like shape, and therefore the worker can not easily slide the electrical contact portion, and therefore there is a fear that the worker can not easily mount the electrical contact portion (that is, the metal terminal) on the terminal connecting portion.

SUMMARY OF THE INVENTION

It is therefore an object of this invention to provide a metal terminal which can be easily mounted on a terminal connecting portion in satisfactorily electrically connected relation thereto, and also to provide an electric distribution box provided with this metal terminal.

The above object has been achieved by a metal terminal of the invention of a first aspect, adapted to be fixedly held between a terminal connecting portion and a fastening member provided at the terminal connecting portion, the metal terminal comprising:

an electrical contact portion which can be slid to be inserted between the fastening member and the terminal connecting portion so as to be connected to the terminal connecting portion;

a wire connecting portion which extends from the electrical contact portion, a wire being adapted to be connected to the wire connecting portion; and an upstanding piece portion which is provided so as to extend in an upstanding manner from the electrical contact portion, and is disposed rearwardly of a connection part of the electrical contact portion in a direction of sliding of the electrical contact portion, wherein the connection part of the electrical contact portion is adapted to be held between the fastening member and the terminal connecting portion.

In the metal terminal of the invention of a second aspect, the upstanding piece portion is provided so as to extend in the upstanding manner from an outer edge of the electrical contact portion.

In the metal terminal of the invention of a third aspect, the upstanding piece portion is provided so as to extend in the upstanding manner from a corner portion of an outer edge of the electrical contact portion.

An electric distribution box of the invention of a fourth aspect, comprising:

a box body; and the metal terminal according to the first to third aspects, which is mounted on the box body.

The electric distribution box of the invention of a fifth aspect, a recessed groove is formed on an outer wall surface of the box body. The wire connecting portion of the metal terminal and the wire connected to the wire connecting portion are received in the recessed groove.

The electric distribution box of the invention of a six aspect, further comprising a side cover which is detachably attached to the box body to close the recessed groove.

In the metal terminal of the invention of the first aspect, the upstanding piece portion is disposed rearwardly of the connection part of the electrical contact portion in the direction of sliding of the electrical contact portion. Therefore, by pressing the upstanding piece portion, the electrical contact portion can be easily slid.

And besides, since the upstanding piece portion can be pressed, the worker can easily mount the metal terminal on the terminal connecting portion without touching the connection portion, etc.

In the metal terminal of the invention of the second aspect, the upstanding piece portion is formed on and extends in an upstanding manner from the outer edge of the electrical contact portion, and therefore the upstanding piece portion is positively disposed rearwardly of the connection portion in the sliding direction.

In the metal terminal of the invention of the third aspect, the upstanding piece portion is formed on and extends in an upstanding manner from the corner portion of the outer edge of the electrical contact portion, and therefore the upstanding piece portion is positively disposed at a position spaced from the connection portion of the electrical contact portion.

In the electrical connection box of the invention of the fourth aspect, the upstanding piece portion is disposed rearwardly of the connection portion of the electrical contact portion of the metal terminal in the direction of sliding of the electrical contact portion. Therefore, by pressing the upstanding piece portion, the electrical contact portion of the metal terminal can be easily slid.

And besides, since the upstanding piece portion can be pressed, the worker can easily mount the metal terminal on the terminal connecting portion without touching the connection portion, etc.

In the electric distribution box of the invention of the fifth aspect, the wire connecting portion of the metal terminal is received in the recessed groove, and therefore the wire connecting portion and the wire connected to the wire connecting portion are received in the recessed groove, and therefore are prevented from projecting outwardly from the box body.

In the electric distribution box of the invention of the sixth aspect, there is provided the side cover for covering the recessed groove, and therefore foreign matters are prevented from being brought into contact with the wire connecting portion in the recessed groove and the wire connected to the wire connecting portion, and besides the rigidity of the box body can be increased.

As described above, in the invention of the first aspect, the electrical contact portion can be easily slid by pressing the upstanding piece portion disposed rearwardly of the connection part of the electrical contact portion in the direction of sliding of the electrical contact portion, and therefore the electrical contact portion can thus be easily slid, and the electrical contact portion of the metal terminal can be easily mounted on the terminal connecting portion.

And besides, the worker can mount the metal terminal on the terminal connecting portion without touching the connection portion, etc., and therefore fibers of the worker's glove, etc., are prevented from being held between the connection portion and the terminal connecting portion, and the connection portion and the terminal connecting portion can be satisfactorily electrically connected together.

In the invention of the second aspect, the upstanding piece portion is positively disposed rearwardly of the connection part in the sliding direction, and therefore the metal terminal can be easily mounted on the terminal connecting portion in satisfactorily electrically connected relation thereto.

In the invention of the third aspect, the upstanding piece portion is positively disposed at the position spaced from the connection portion of the electrical contact portion, and therefore the worker is positively prevented from touching the connection portion, and the metal terminal can be easily mounted on the terminal connecting portion in satisfactorily electrically connected relation thereto.

In the invention of the fourth aspect, the electric distribution box is provided with the metal terminal as recited in any one of the first to third aspects, and therefore the metal terminal can be easily mounted on the terminal connecting portion in satisfactorily electrically connected relation thereto.

In the invention of the fifth aspect, the wire connecting portion and the wire connected to the wire connecting portion are prevented from projecting outwardly from the box body, and therefore the compact design can be achieved.

In the invention of the sixth aspect, foreign matters are prevented from being brought into contact with the wire received in the recessed groove, and also the wire is prevented from being disengaged from the recessed groove. Therefore, the wire in the recessed groove is prevented from being accidentally broken. Furthermore, the side cover closes the recessed groove, and therefore the rigidity of the box body can be increased.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

One preferred embodiment of an electric distribution box of the present invention will now be described with reference to FIGS. 1 to 7. The electric distribution box 1 of this embodiment is mounted on an automobile serving as a mobile body.

Figure 1:
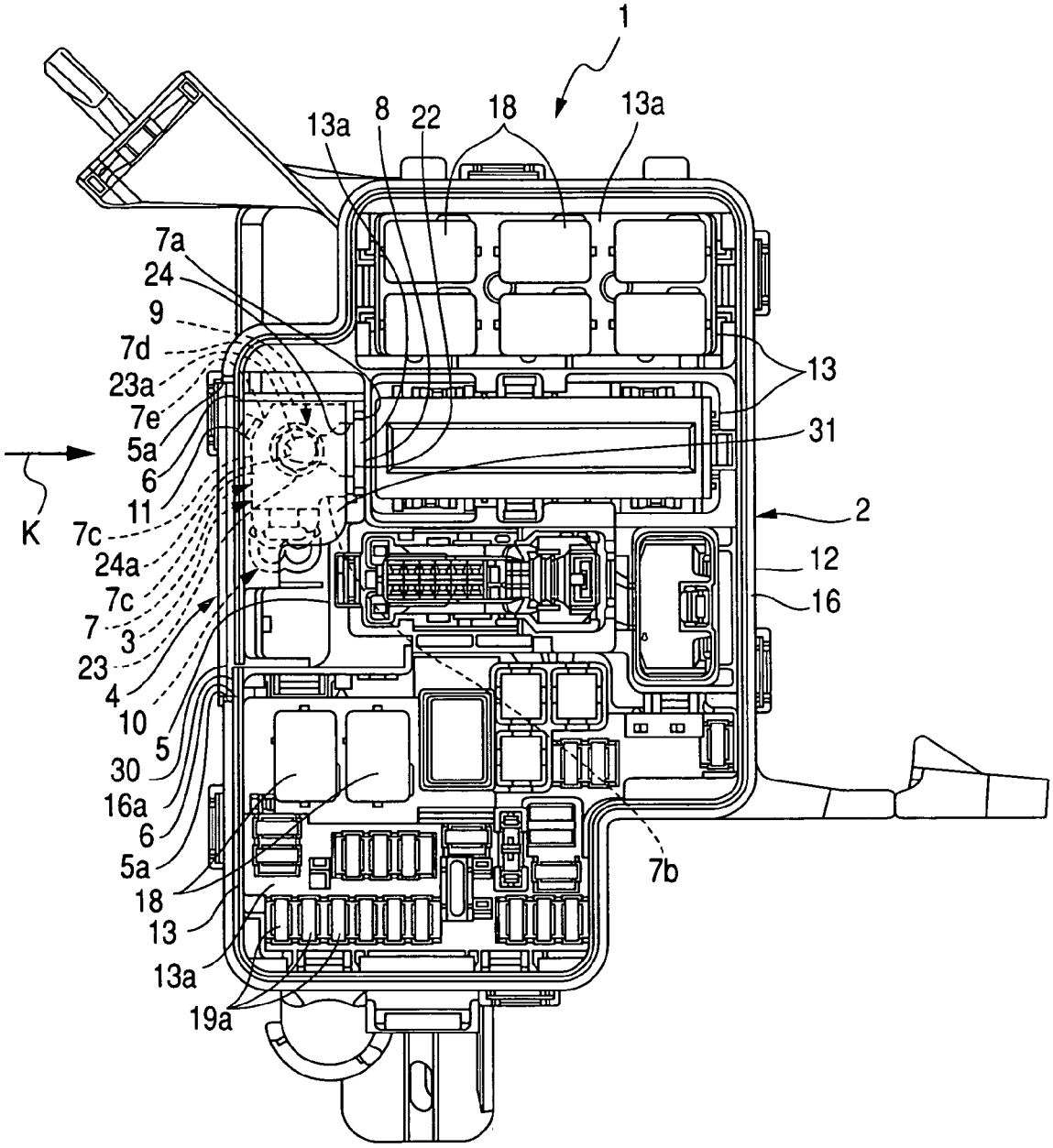
FIG. 1 is a plan view of a body portion of a box body of one preferred embodiment of an electric distribution box of the present invention.
Figure 2:
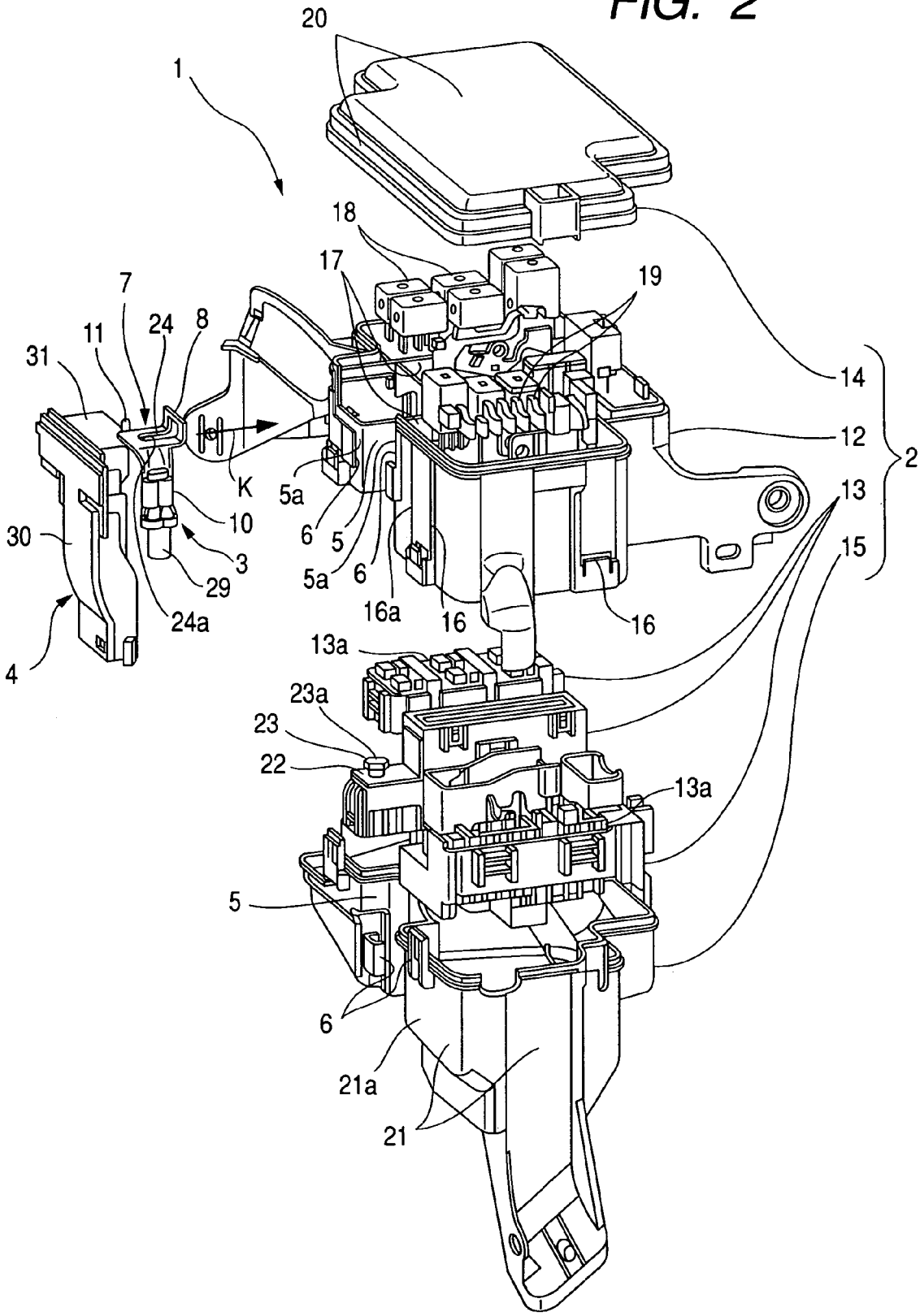
FIG. 2 is an exploded, perspective view of the electric distribution box of FIG. 1.

As shown in FIG. 1, the electric distribution box 1 includes a box body 2, a wiring board (not shown), a metal terminal 3, a side cover 4 and so on. As shown in FIG. 2, the box body 2 includes a body portion 12, a plurality of cassette blocks 13, an upper cover 14, and a lower cover 15. The body portion 12 is formed of an insulative synthetic resin, and is molded by a well known injection molding method. The body portion 12 is formed into a tubular shape defined by a plurality of outer walls 16 continuous with one another. The body portion 12 includes partition walls 17 which divide the interior of the body portion 12 into a plurality of sections.

Each of the cassette blocks 13 is formed into a generally box-shape, and is so sized as to be received within the body portion 12. The cassette blocks 13 are inserted into the body portion 12 through a lower opening (in FIG. 3) thereof. The cassette blocks 13 receive metal terminals (not shown) therein. Connectors of a wire harness (not shown) are fitted to lower-side (in FIG. 2) surfaces (hereinafter referred to as "lower surfaces") of the cassette blocks 13. This wire harness includes a plurality of wires, and the connectors secured to end portions of the wires.

Relays 18, fuses 19 and so on (which are electric parts) are mounted at upper-side (in FIG. 2) surfaces 13*a* (hereinafter referred to as "upper surfaces") of the cassette blocks 13. A terminal mounting portion 9 is provided at the upper surface (in FIG. 3) of one cassette block 13. When the cassette block 13 is mounted in the body portion 12, the terminal mounting portion 9 is located in the vicinity of a recessed groove 5 (described later). The terminal mounting portion 9 includes a metal sheet member 22 (shown in FIG. 5) (serving as a terminal connecting portion) exposed to the upper surface 13*a*, a nut (not shown) disposed at the lower side (in FIG. 5) of the metal sheet member 22, and a bolt 23 (serving as a fastening member) having a threaded portion threaded in the nut (that is, threadedly connected to the metal sheet member 22).

An electrical contact portion 7 (shown in FIG. 2 and described later) of the metal terminal 3 is superposed on the metal sheet member 22, and then the bolt 23 is passed through a notch 24 formed in the electrical contact portion 7, and is threaded into the nut, and by doing so, the metal terminal 3 is mounted on the terminal mounting portion 9, with the electrical contact portion 7 held between the metal sheet member 22 and a head 23*a* of the bolt 23.

The metal terminals provided in the cassette blocks 13 connect metal terminals of the connectors of the wire harness to the electric parts (i.e., the relays 18, the fuses 19, etc.), the metal sheet member 22 of the terminal mounting portion 9, etc. The cassette blocks 13 electrically connect the electric parts (the relays 18, the fuses 19, etc.), the wires of the wire harness, and a wire 29 (described later) connected to the metal terminal 3 in a predetermined pattern.

The upper cover 14 is formed of an insulative synthetic resin, and is molded by a well known injection molding method. The upper cover 14 has a plurality of outer walls 20 continuous with one another, and is formed into a generally tubular shape with a closed top. The upper cover 14 is attached to the body portion 12 to cover the upper side (in FIG. 2) of this body portion 12.

The lower cover 15 is formed of an insulative synthetic resin, and is molded by a well known injection molding method. The lower cover 15 has a plurality of outer walls 21 continuous with one another, and is formed into a generally tubular shape with a closed bottom. The lower cover 15 is attached to the body portion 12 to cover the lower side (in FIG. 2) of this body portion 12.

Figure 5:
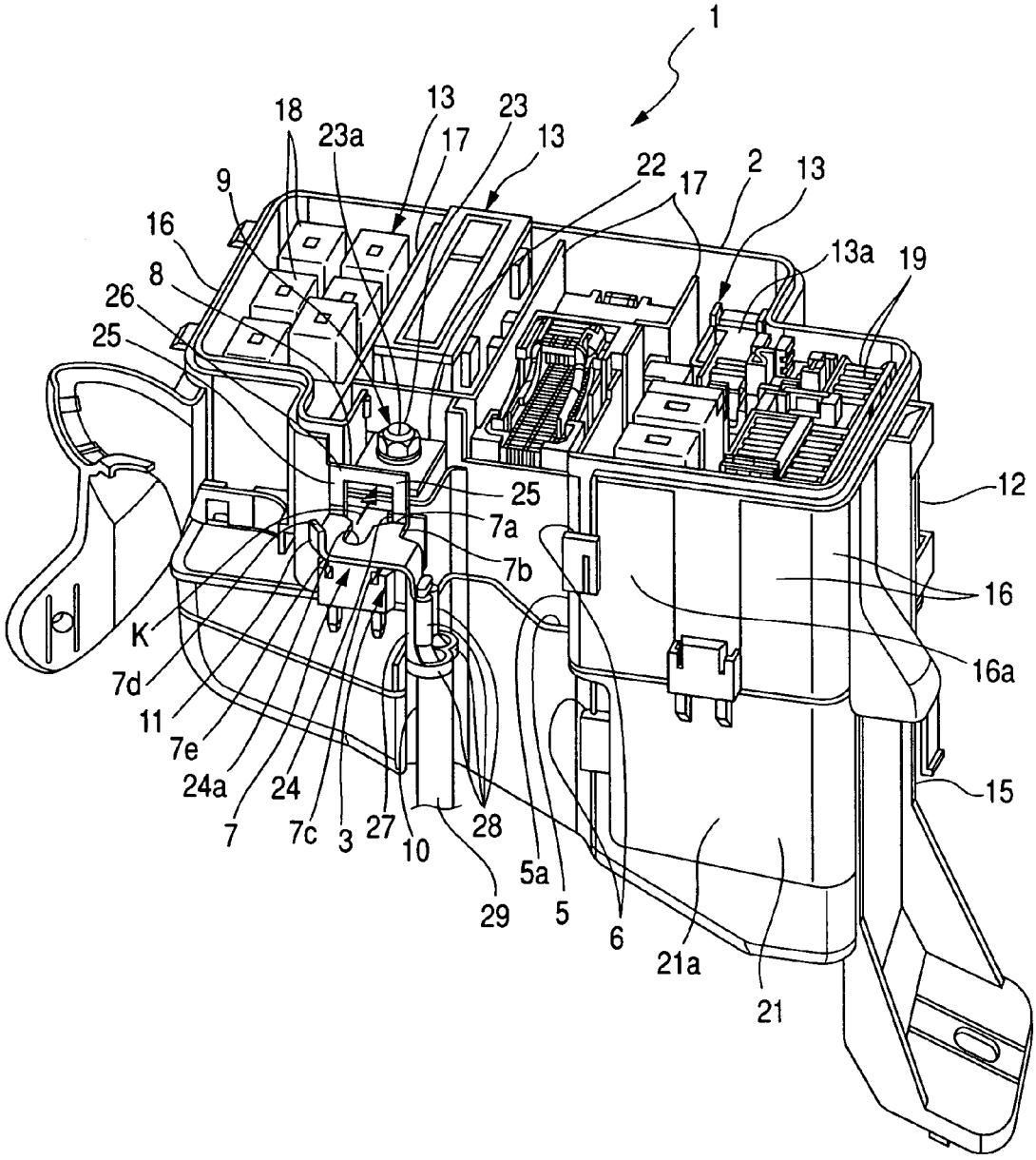
FIG. 5 is a perspective view showing a condition in which a notch of the metal terminal is opposed to a terminal mounting portion of the box body of the electric distribution box of FIG. 1.
Figure 6:
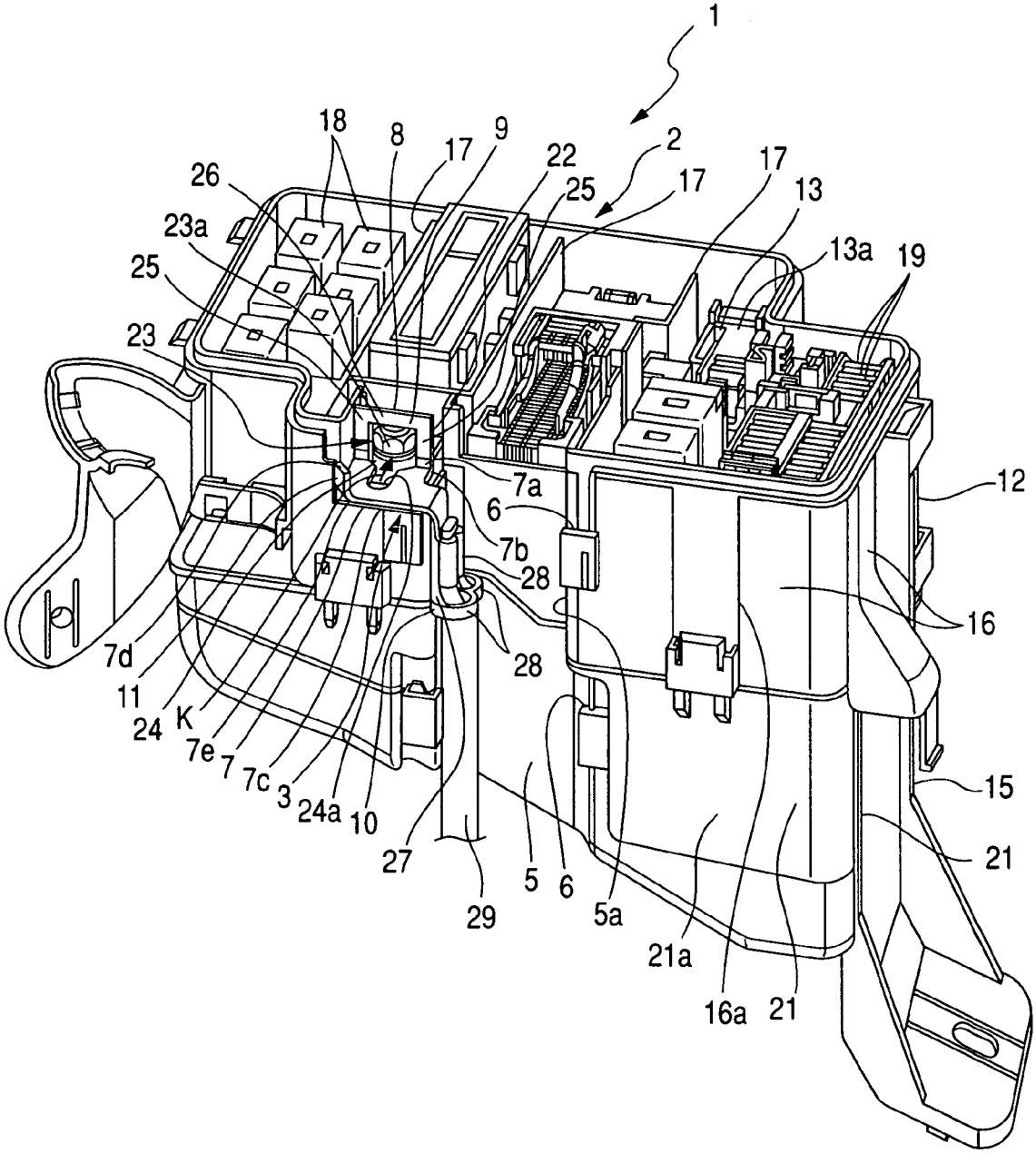
FIG. 6 is a perspective view showing a condition in which the metal terminal of FIG. 5 is moved toward the box body of the electric distribution box.
Figure 7:
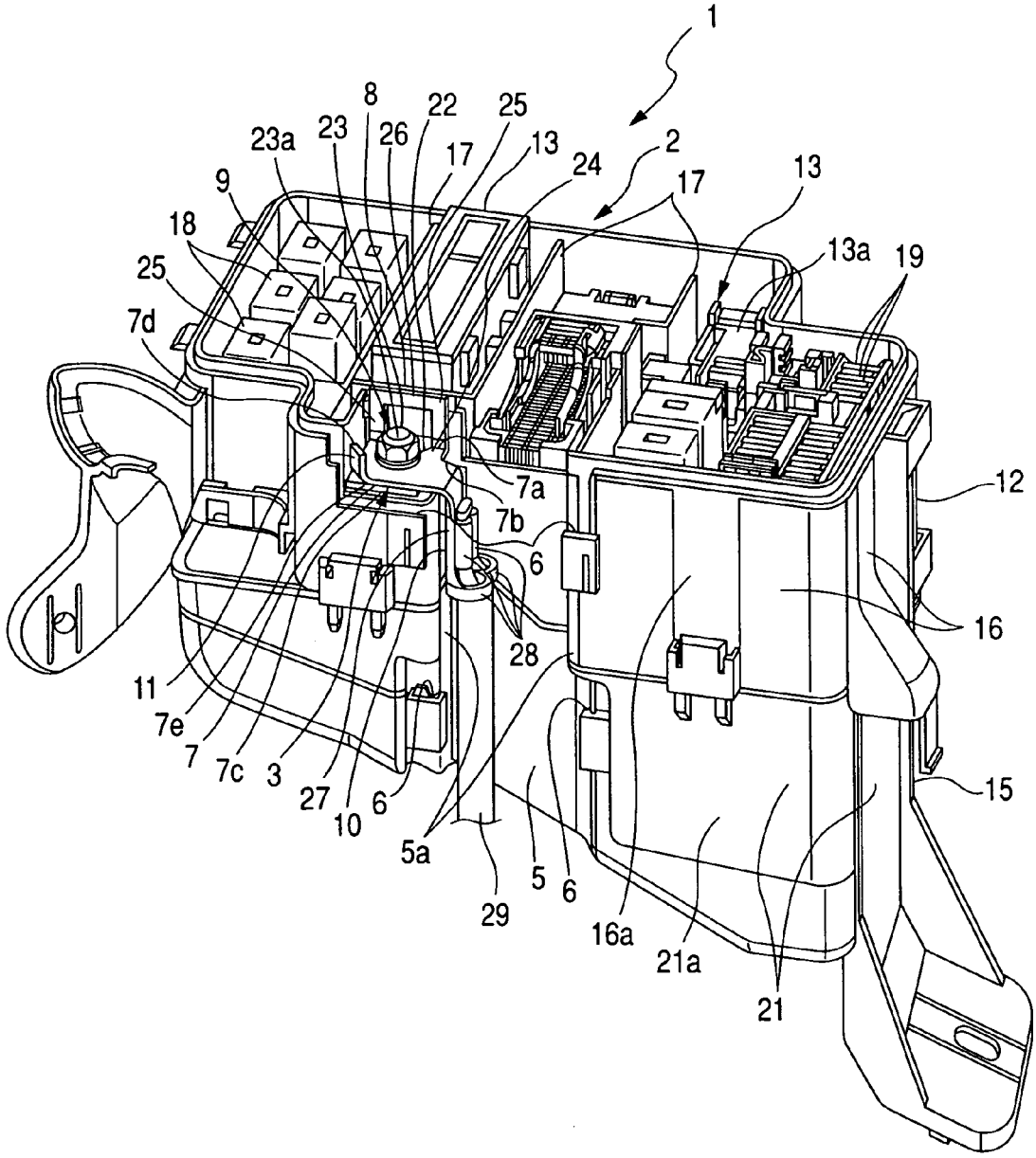
FIG. 7 is a perspective view showing a condition in which the metal terminal of FIG. 6 is mounted on the terminal mounting portion of the box body of the electric distribution box.

As shown in FIGS. 5 to 7, the recessed groove 5 is formed in a continuous manner in a surface (hereinafter referred to as "outer wall surface") 16*a* of one outer wall 16 of the body portion 12 and a surface (hereinafter referred to as "outer wall surface") 21*a* of one outer wall 21 of the lower cover 15 continuous with the outer wall surface 16*a*, the recessed groove 5 being recessed from the outer wall surfaces 16*a* and 21*a* and extending over entire heights of these outer wall surfaces 16*a* and 21*a*. Namely, the electric distribution box 1 has the recessed groove 5. The recessed groove 5 extends linearly in a direction of opposing of the upper surface 13*a* and lower surface of each cassette block 13 to each other.

Slide grooves 6 are formed respectively in inner edge portions 5*a* of the recessed groove 5 opposed to each other in a direction perpendicular to the direction of opposing of the upper surface 13*a* and lower surface of each cassette block to each other, and extend in the direction of opposing of the upper surface 13*a* and lower surface to each other. Each slide groove 6 is recessed from the corresponding inner edge portion 5*a* in a direction of the width of the recessed groove 5. The slide grooves 6 are formed in the body portion 12 and the lower cover 15. The terminal mounting portion 9 is provided in the vicinity of the recessed groove 5.

The electric parts (the relays 18, the fuses 19, etc.) are mounted on the cassette blocks 13 mounted in the body portion 12, and the metal terminal 3 is mounted on the terminal mounting portion 9, and the upper cover 14 and the lower cover 15 are attached to the body portion 12 as described above. Thus, the electric parts (the relays 18, the fuses 19, etc.) and the metal terminal 3 are received in the box body 2.

Figure 3:
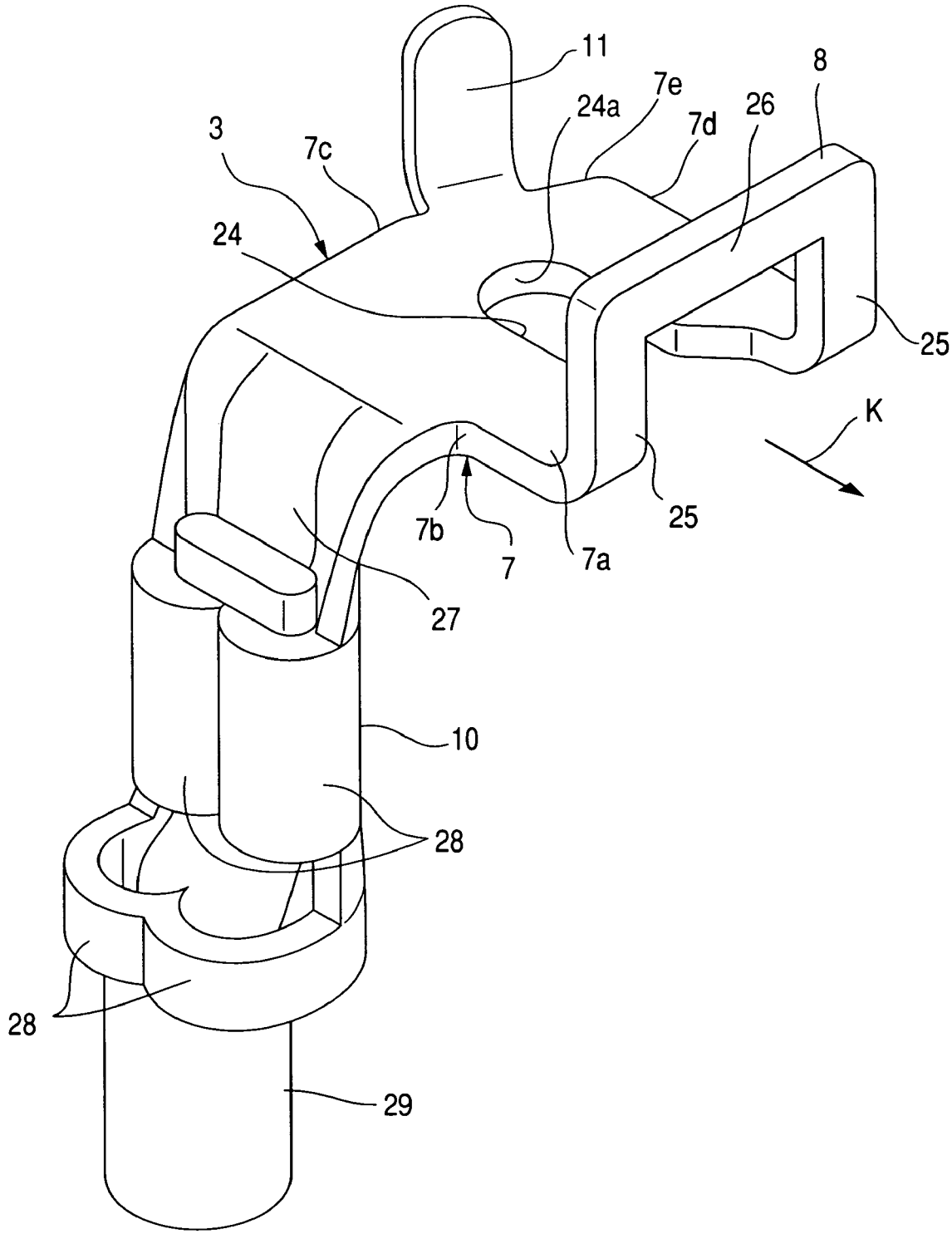
FIG. 3 is a perspective view of a wire-connected metal terminal used in the electric distribution box of FIG. 1.

The metal terminal 3 can be obtained, for example, by bending a relatively thick metal sheet. As shown in FIG. 3, the meta terminal 3 includes the flat plate-like electrical contact portion 7, a reinforcing bridge portion 8, a wire connecting portion 10, and an upstanding piece portion 11, and these portions are formed integrally with one another.

The electrical contact portion 7 has a generally rectangular shape in plane. The electrical contact portion 7 has the notch 24 through which the threaded portion of the bolt 23 can pass. The notch 24 extends inwardly from one outer edge 7*a* of the electrical contact portion 7, and is formed by removing or notching part of the electrical contact portion 7. The notch 24 in the electrical contact portion 7 is gradually decreasing in width away from the one outer edge 7*a*.

The electrical contact portion 7 is slid in a direction of arrow K, that is, in a longitudinal direction of the notch 24, so that the threaded portion of the bolt 23 of the terminal mounting portion 9 is passed through the notch 24. Then, an inner end portion 24*a* of the notch 24 remote from the one outer edge 7*a* and that portion of the electrical contact portion 7 disposed in the vicinity of this inner end portion 24*a* are held between the metal sheet member 22 of the terminal mounting portion 9 and the head 23*a* of the bolt 23. The inner end portion 24*a* and the portion of the electrical contact portion 7 disposed in the vicinity of the inner end portion 24*a* jointly form a connection part. The electrical contact portion 7 is mounted on the terminal mounting portion 9 in such a manner that the one outer edge 7*a* is disposed within the electric distribution box 1 in parallel relation to the outer wall surfaces 16*a* and 21*a*.

The reinforcing bridge portion 8 includes a pair of upstanding portions 25, and an interconnecting portion 26 interconnecting the pair of upstanding portions 25, the upstanding portions 25 and the interconnecting portion 26 being formed integrally with each other. The pair of upstanding portions 25 are formed on and extend upwardly from the one outer edge 7*a* of the electrical contact portion 7. The notch 24 is disposed between the pair of upstanding portions 25. The reinforcing bridge portion 8 interconnects those portions of the one outer edge 7*a* separated from each other by the notch 24 disposed therebetween, thereby preventing the width of the notch 24 from being changed. Namely, the reinforcing bridge portion 8 increases the rigidity (strength) of the electrical contact portion 7.

The wire connecting portion 10 includes a bottom plate portion 27, and a plurality of press-clamping piece portions 28. The bottom plate portion 27 is bent at one end of the electrical contact portion 7, and extends generally perpendicularly from the electrical contact portion 7. In the illustrated embodiment, the angle between the bottom plate portion 27 and the electrical contact portion 7 is about 90 degrees. The bottom plate portion 27 extends generally perpendicularly from another outer edge 7*b* of the electrical contact portion 7 which is continuous with the one outer edge 7*a* to which the notch 24 is open, the bottom plate portion 27 extending in a direction opposite to the direction of projecting of the reinforcing bridge portion 8. When the electrical contact portion 7 is mounted on the terminal mounting portion 9, the outer edge 7*b* is disposed perpendicular to the outer wall surfaces 16*a* and 21*a*. The wire connecting portion 10 has the bottom plate portion 27, and therefore extends generally perpendicularly from the electrical contact portion 7.

The press-clamping piece portions 28 extend from widthwise-opposite side edges of the bottom plate portion 27. The press-clamping piece portions 28 are bent toward the bottom plate portion 27, so that the wire 29 is held between the bottom plate portion 27 and the press-clamping piece portions 28. Thus, the wire 29 is press-fastened by the press-clamping piece portions 28. By thus press-fastening the wire 29 by the press-clamping piece portions 28, the wire 29 is fixedly secured to the wire connecting portion 10, and is electrically connected thereto.

The upstanding piece portion 11 is formed on and extends in an upstanding manner from a corner portion 7*e* of the electrical contact portion 7 (into which outer edges 7*c* and 7*d* thereof merge) which is disposed rearwardly of the inner end portion 24*a* of the notch 24 in the sliding direction K when the electrical contact portion 7 is mounted on the terminal mounting portion 9, the upstanding piece portion 11 projecting from the corner portion 7*e* in the same direction as the direction of projecting of the reinforcing bridge portion 8. Namely, the upstanding piece portion 11 projects generally perpendicularly from both of the outer edge 7*c* (which is parallel to the outer wall surfaces 16*a* and 21*a*, and is disposed rearwardly of the inner end portion 24*a* in the sliding direction K) and the outer edge 7*d* which is continuous with the outer edge 7*c*, and is perpendicular to the outer wall surfaces 16*a* and 21*a*. The corner portion 7*e* is disposed at the intersection of the outer edges 7*c* and 7*d* and its vicinity.

The wire 29 is fixedly secured to the wire connecting portion 10 of the metal terminal 3, and then the metal terminal 3 is slid in the sliding direction K parallel to the longitudinal direction of the notch 24, so that the electrical contact portion 7 is inserted between the metal sheet member 22 of the terminal mounting portion 9 and the head 23*a* of the bolt 23, with the one outer edge 7*a* disposed within the electric distribution box 1. As a result, the threaded portion of the bolt 23 is inserted into the notch 24, and the wire connecting portion 10 and the wire 29 are received in the recessed groove 5. The threaded portion of the bolt 23 is held against the inner end portion 24*a* of the notch 24, and in this condition the bolt 23 is tightened, so that the electrical contact portion 7 is firmly held between the metal sheet member 22 and the head 23*a* of the bolt 23, thus mounting the metal terminal 3 on the terminal mounting portion 9.

At this time, the inner end portion 24*a* of the notch 24 and the portion of the electrical contact portion 7 disposed in the vicinity of the inner end portion 24*a* (which jointly form the connection portion of the electrical contact portion 7) are held between the metal sheet member 22 and the head 23*a* of the bolt 23. In the illustrated embodiment, the wire 29 fixedly secured to the metal terminal 3 is connected to a power source such as a battery.

Figure 4:
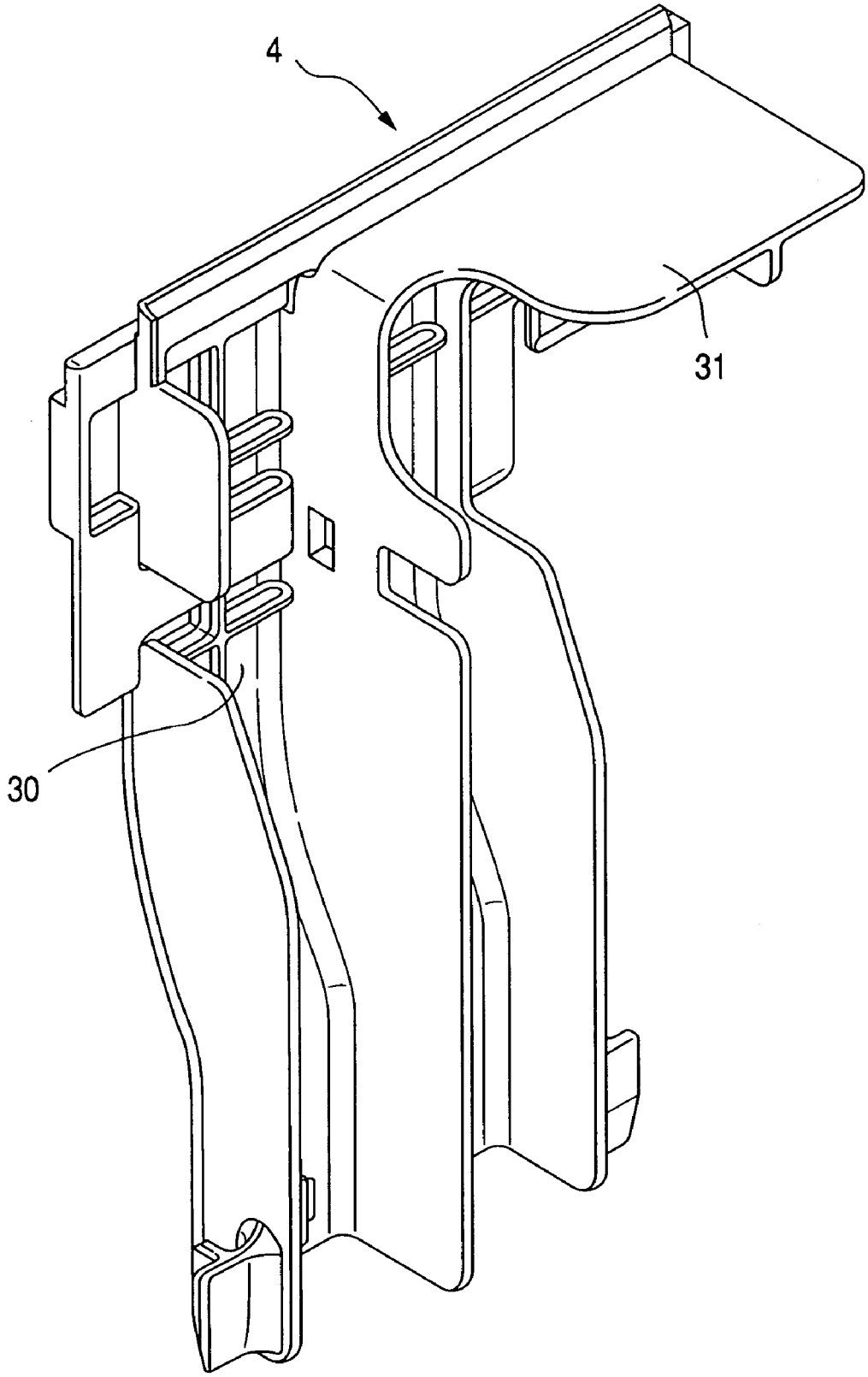
FIG. 4 is a perspective view of a side cover used in the electric distribution box of FIG. 1.

The side cover 4 is formed of an insulative synthetic resin, and is molded by a well known injection molding method. As shown in FIG. 4, the side cover 4 includes a flat plate-like body portion 30 and a covering wall 31 which are formed integrally with each other. The body portion 30 has a generally rectangular shape in plane which is generally equal to the shape of the recessed groove 5 in plane. The body portion 30 is attached to the box body 2, with its widthwise-opposite side edge portions inserted respectively in the slide grooves 6.

When the body portion 30 (that is, the side cover 4) is attached to the box body 2, the body portion 30 lies generally flush with the outer wall surfaces 16*a* and 21*a* (in which the recessed groove 5 is formed), and also closes the opening of the recessed groove 5 open to the outer walls 16 and 21. Thus, the body portion 30 (that is, the side cover 4), when attached to the box body 2, closes the recessed groove 5. The body portion 30 (that is, the side cover 4), when thus attached to the box body 2, does not close opposite (upper and lower) end openings of the recessed groove 5 disposed near respectively to the upper surfaces 13 and lower surfaces of the cassette blocks (Namely, these opposite end openings of the recessed groove 5 are kept open).

The covering wall 31 extends perpendicularly from an upper end (which is to be disposed near to the upper surfaces 13*a*) of the body portion 30 of the side cover 4, and when the side cover 4 is attached to the box body 2 and so on, the covering wall 31 is directed toward the inside of the electric distribution box 1. The covering wall 31 is disposed parallel to the upper surfaces 13*a* and lower surfaces of the cassette blocks 13. The body portion 30 (that is, the side cover 4), when attached to the box body 2, covers the head 23*a* of the bolt 23.

The above electric distribution box 1 is assembled in the following manner. First, the cassette blocks 13 are mounted in the body portion 12 of the box body 2. The electric parts (the relays 18, the fuses 19, etc.) are mounted on the upper surfaces 13*a* of the cassette blocks 13, and the connectors of the wire harness are fitted to the lower surfaces of the cassette blocks.

Then, the lower cover 15 is attached to the body portion 12. Then, the notch 24, formed in the electrical contact portion 7 of the metal terminal 3 having the wire 29 connected thereto, is located in opposed relation to the bolt 23 of the terminal mounting portion 9 as shown in FIG. 5, and the electrical contact portion 7 of the metal terminal 3 is gradually moved toward the terminal mounting portion 9 in the longitudinal direction of the notch 24 (that is, in the sliding direction indicated by arrow K). As a result, the threaded portion of the bolt 23 intrudes into the notch 24 as shown in FIG. 6.

The electrical contact portion 7 of the metal terminal 3 is further moved toward the terminal mounting portion 9 in the longitudinal direction of the notch 24 (that is, in the sliding direction indicated by arrow K). As a result, the threaded portion of the bolt 23 abuts against the inner end portion 24*a* of the notch 24 in the electrical contact portion 7 as shown in FIG. 7. Then, the bolt 23 is tightened, thereby holding the electrical contact portion 7 of the metal terminal 3 between the head 23*a* of the bolt 23 and the metal sheet member 22 of the terminal mounting portion 9, thus fixing the metal terminal 3 to the terminal mounting portion 9. As a result, the wire connecting portion 10 of the metal terminal 3 and the wire 29 connected to the wire connecting portion 10 are received in the recessed groove 5. Then, the upper cover 14 is attached to the body portion 12, and the opposite side edge portions of the body portion 30 of the side cover 4 are inserted respectively into the slide grooves 6, thereby attaching the side cover 4 to the box body 2.

As a result, the side cover 4 closes the recessed groove 5. Thus, the electric distribution box 1 of the above construction is assembled. The electric distribution box 1 is mounted on the automobile. The electric distribution box 1 electrically connects electronic equipments (mounted on the automobile) to which the wire harness is connected, the electric parts (the fuses 19, the relays 18, etc.) and the power source (to which the wire 29 is connected) together in a predetermined pattern.

In this embodiment, the upstanding piece portion 11 is formed on and extends in an upstanding manner from the electrical contact portion 7, and is disposed rearwardly of the inner end portion 24*a* of the notch 24 of the electrical contact portion 7 in the sliding direction K. Therefore, by pressing the upstanding piece portion 11, the electrical contact portion 7 can be easily slid. Therefore, the electrical contact portion 7 can thus be easily slid, and the electrical contact portion 7 of the metal terminal 3 can be easily mounted on the terminal mounting portion 9.

And besides, since the upstanding piece portion 11 can be pressed, the worker can mount the metal terminal 3 on the terminal mounting portion 9 without touching the inner end portion 24*a* of the notch 24, etc., of the electrical contact portion 7. Therefore, fibers of the worker's glove and others are prevented from being held between the inner end portion 24*a* of the notch 24 and the metal sheet member 22 of the terminal mounting portion 9, and the electrical contact portion 7 of the metal terminal 3 and the terminal mounting portion 9 can be satisfactorily electrically connected together.

The upstanding piece portion 11 is formed on and extends in an upstanding manner from the outer edges 7*c* and 7*d* of the electrical contact portion 7, and therefore this upstanding piece portion 11 is positively disposed rearwardly of the inner end portion 24*a* of the notch 24 in the sliding direction K. Therefore, the metal terminal 3 can be easily mounted on the terminal mounting portion 9 in satisfactorily electrically connected relation thereto.

The upstanding piece portion 11 is formed on and extends in an upstanding manner from the corner portion 7*e* of the electrical contact portion 7 at which the outer edges 7*c* and 7*d* thereof intersect each other, and therefore the upstanding piece portion 11 is positively disposed at the position spaced from the inner end portion 24*a* of the notch 24 in the electrical contact portion 7. Therefore, the worker is positively prevented from touching the inner end portion 24*a* of the notch 24, etc., and the metal terminal 3 can be easily mounted on the terminal mounting portion 9 in satisfactorily electrically connected relation thereto.

The wire connecting portion 10 of the metal terminal 3 is received in the recessed groove 5 formed in the box body 2, and therefore the wire connecting portion 10 and the wire 29 connected to the wire connecting portion 10 are received in the recessed groove 5, and are prevented from projecting outwardly from the box body 2. Therefore, the compact design of the electric distribution box 1 can be achieved.

The side cover 4 is provided to close the recessed groove 5 in the box body 2, and therefore foreign matters are prevented from being brought into contact with the wire connecting portion 10 and the wire 29 connected to the wire connecting portion 10, and besides the rigidity of the box body 2 can be increased. Therefore, the wire 29 within the recessed groove 5 is prevented from being accidentally broken. Furthermore, since the side cover 4 closes the recessed groove 5, the rigidity of the box body 2 can be increased.

The above embodiment is merely a typical form of the invention, and the invention is not limited to the above embodiment. Namely, various modifications can be made without departing from the subject matter of the invention. For example, any other suitable part than the bolt 23 can be used as the fastening member, and also any other suitable portion than the inner end portion 24*a* of the notch 24 can be used as the connection portion.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2005-337548 filed on Nov. 22, 2005, the contents of which are incorporated herein for reference.

What is claimed is:

1. A metal terminal adapted to be fixedly held between a terminal connecting portion and a fastening member provided at the terminal connecting portion, the metal terminal comprising:

an electrical contact portion which can be slid to be inserted between the fastening member and the terminal connecting portion so as to be connected to the terminal connecting portion;

a wire connecting portion which extends from the electrical contact portion, a wire being adapted to be connected to the wire connecting portion; and an upstanding piece portion which is provided so as to extend in an upstanding manner from the electrical contact portion, and is disposed rearwardly of a connection part of the electrical contact portion in a direction of sliding of the electrical contact portion, wherein the connection part of the electrical contact portion is adapted to be held between the fastening member and the terminal connecting portion, and wherein the wire connecting portion extends from a side of the electrical contact portion, the side including a width and a length, wherein the length of the side is generally parallel to the direction of sliding of the electrical contact portion.

2. The metal terminal according to claim 1, wherein the upstanding piece portion is provided so as to extend in the upstanding manner from an outer edge of the electrical contact portion.

3. The metal terminal according to claim 1, wherein the upstanding piece portion is provided so as to extend in the upstanding manner from a corner portion of an outer edge of the electrical contact portion.

4. An electric distribution box, comprising:

a box body; and the metal terminal according to claim 1, which is mounted on the box body.

5. The electric distribution box according to claim 4, wherein a recessed groove is formed on an outer wall surface of the box body; and wherein the wire connecting portion of the metal terminal and the wire connected to the wire connecting portion are received in the recessed groove.

6. The electric distribution box according to claim 5, further comprising a side cover which is detachably attached to the box body to close the recessed groove.

7. The electric distribution box according to claim 1, wherein the wire connecting portion is bent so that it extends from the electrical contact portion in a direction that is generally perpendicular to the electrical contact portion.

8. The electric distribution box according to claim 7, wherein the wire connecting portion comprises a plate portion and a press clamping portion, and the press clamping portion is connected to the electrical contact portion via the plate portion.

9. The electric distribution box according to claim 8, further comprising a reinforcing bridge that extends from a side of the electrical contact portion that is opposite to the upstanding piece portion.

10. The electric distribution box according to claim 9, wherein the electrical contact portion includes a notch through which the fastening member passes.

* * * * *